US011311447B2

(12) United States Patent
Gordon et al.

(10) Patent No.: US 11,311,447 B2
(45) Date of Patent: Apr. 26, 2022

(54) AGILITY TRAINER

(71) Applicants: Northwestern University, Evanston, IL (US); U.S. Department of Veterans Affairs, Washington, DC (US)

(72) Inventors: Keith E. Gordon, Evanston, IL (US); Geoffrey L. Brown, Chicago, IL (US); Mengnan Wu, Chicago, IL (US); Felix C. Huang, Chicago, IL (US)

(73) Assignees: Northwestern University, Evanston, IL (US); U.S. Department of Veterans Affairs, Washington, DC (US)

( * ) Notice: Subject to any disclaimer, the term of this patent is extended or adjusted under 35 U.S.C. 154(b) by 293 days.

(21) Appl. No.: 16/627,074

(22) PCT Filed: Jun. 29, 2018

(86) PCT No.: PCT/US2018/040294

§ 371 (c)(1),
(2) Date: Dec. 27, 2019

(87) PCT Pub. No.: WO2019/006304

PCT Pub. Date: Jan. 3, 2019

(65) Prior Publication Data

US 2020/0222266 A1 Jul. 16, 2020

Related U.S. Application Data

(60) Provisional application No. 62/527,779, filed on Jun. 30, 2017.

(51) Int. Cl.
*A61H 3/00* (2006.01)
*A63B 21/04* (2006.01)
(Continued)

(52) U.S. Cl.
CPC ..... *A61H 3/008* (2013.01); *A63B 21/0428* (2013.01); *A63B 21/055* (2013.01);
(Continued)

(58) Field of Classification Search
CPC ..... A61B 24/0075; A61B 71/0622; A61B 23/0458; A61B 22/02; A61B 2220/836; A61B 2220/40; A61B 2220/12; A61B 2220/10; A61B 2071/0694; A61B 2071/0661; A61B 2071/0658; A61B 2071/0655; A61B 2071/065;
(Continued)

(56) References Cited

U.S. PATENT DOCUMENTS 1,016,729 A * 2/1912 Barrett ..... A63B 22/02 482/54
5,368,532 A * 11/1994 Farnet ..... A63B 22/02 482/5

(Continued)

OTHER PUBLICATIONS

Sep. 20, 2018—(WO) International Search Report and Written Opinion—App PCT/US2018/040294.

*Primary Examiner* — Garrett K Atkinson
(74) *Attorney, Agent, or Firm* — Banner & Witcoff, Ltd.

(57) ABSTRACT

An agility trainer apparatus that provides a robotic system that applies forces laterally to a harness worn by a person during walking so as to provide highly controllable interventions targeting locomotor stability.

20 Claims, 5 Drawing Sheets

(51) Int. Cl.
*A63B 21/055* (2006.01)
*A63B 22/02* (2006.01)
*A63B 26/00* (2006.01)
*A63B 22/00* (2006.01)

(52) U.S. Cl.
CPC ..... *A63B 22/02* (2013.01); *A63B 26/003* (2013.01); *A61H 2201/123* (2013.01); *A61H 2201/1261* (2013.01); *A61H 2201/149* (2013.01); *A61H 2201/163* (2013.01); *A61H 2201/1652* (2013.01); *A61H 2201/5061* (2013.01); *A61H 2201/5064* (2013.01); *A63B 2022/0092* (2013.01)

(58) Field of Classification Search
CPC ..... A61B 2071/0638; A61B 2225/20; A61B 22/0285; A61B 2220/05; A61B 21/0428; A61B 21/055; A61B 26/003; A61B 2022/0092; A61B 21/4009; A61B 23/047; A61B 2024/0093; A61B 2220/13; A61B 2220/30; A61B 2220/51; A61B 2220/805; A61B 2220/806; A61B 22/0235; A61B 21/04; A61B 21/0058; A61B 24/0087; A61B 69/0053; A61H 3/008; A61H 2201/123; A61H 2201/1261; A61H 2201/149; A61H 2201/163; A61H 2201/1652; A61H 2201/5061; A61H 2201/5064; A61H 2201/0126; A61H 2201/1207; A61H 3/00
See application file for complete search history.

(56) References Cited

U.S. PATENT DOCUMENTS 5,690,587 A * 11/1997 Gruenangerl ..... A63B 22/02 482/54
5,800,314 A * 9/1998 Sakakibara ..... A63B 22/02 482/1
6,123,649 A * 9/2000 Lee ..... A63B 21/153 482/51
6,652,427 B2 * 11/2003 Wroclawsky ..... A63B 22/02 482/111
7,101,319 B1 * 9/2006 Potts ..... A63B 22/0257 482/51
8,007,408 B1 * 8/2011 Moran ..... A63B 22/025 482/54
8,246,354 B2 * 8/2012 Chu ..... A63B 22/0292 434/258
8,920,347 B2 * 12/2014 Bayerlein ..... A61H 1/0262 601/35
9,737,453 B2 * 8/2017 Shimada ..... A61H 1/0266
9,737,760 B2 * 8/2017 Harrer ..... A63B 21/4015
9,757,610 B2 * 9/2017 Artemiadis ..... A63B 22/0221
9,795,819 B2 * 10/2017 Wehrell ..... A63B 21/0552
9,849,333 B2 * 12/2017 Fung ..... A63B 71/0622
10,328,303 B2 * 6/2019 Frank ..... A63B 21/4035
10,449,403 B2 * 10/2019 Lilley ..... A63B 22/02
10,772,786 B2 * 9/2020 Suzuki ..... B66D 1/505
11,065,500 B1 * 7/2021 Tuck ..... A63B 21/4019
2004/0019304 A1 * 1/2004 West ..... A61H 1/0237 601/5
2004/0147369 A1 * 7/2004 Jimenez Laso ..... A63B 22/025 482/8
2005/0255971 A1 * 11/2005 Solomon ..... A63B 21/00181 482/54
2006/0052728 A1 * 3/2006 Kerrigan ..... A63B 21/4009 600/595
2006/0247104 A1 * 11/2006 Grabiner ..... A63B 22/0235 482/54
2013/0225371 A1 * 8/2013 Harrer ..... A63B 21/16 482/8
2014/0087922 A1 * 3/2014 Bayerlein ..... A63B 21/00181 482/54
2015/0173652 A1 * 6/2015 Brunner ..... A63B 22/0235 482/7
2015/0320632 A1 * 11/2015 Vallery ..... A61G 7/1061 482/69
2016/0317866 A1 * 11/2016 Fung ..... A63B 22/06
2017/0027803 A1 * 2/2017 Agrawal ..... A61B 5/224
2017/0136289 A1 * 5/2017 Frank ..... A63B 22/025
2017/0165145 A1 * 6/2017 Aryananda ..... A61H 3/008
2021/0001171 A1 * 1/2021 Fung ..... A63F 13/40

* cited by examiner

AGILITY TRAINER

CROSS-REFERENCE TO RELATED APPLICATION

This application is a U.S. National Stage application under 35 U.S.C. § 371 of International Application PCT/US2018/040294 (published as WO 2019/006304 A1), filed Jun. 29, 2018 which claims the benefit of priority to U.S. Application Ser. No. 62/527,779, filed Jun. 30, 2017. Each of these prior applications are hereby incorporated by reference in their entirety.

CONTRACTUAL ORIGIN OF THE INVENTION

This invention was made with government support from the U.S. Department of Veterans Affairs. The government has certain rights in the invention.

FIELD OF THE INVENTION

The present disclosure generally relates to the field of rehabilitation robotics, and more particularly to devices and methods used in exercise and/or rehabilitation to improve balance and stability during walking, running and/or standing.

BACKGROUND OF THE INVENTION

Currently, there is a lack of equipment that may be used to enhance stability during walking, running or standing in people with muscular, neurological or skeletal impairments. With respect to walking or running, controlling center of mass (COM) position and velocity within a dynamic base of support is essential for gait stability. This skill is often compromised following neurologic injury.

Although physical therapy interventions have a high probability for improving walking speed after stroke and motor incomplete spinal cord injury (iSCI), falls remain a substantial problem for both populations. As a result, there is a long felt need to develop effective strategies to enhance gait stability after neurologic injury.

SUMMARY

The present disclosure provides methods and apparatus that apply a movement augmentation or amplification paradigm to walking with the goal of improving control of frontal-plane center of mass (COM) dynamics to enhance gait stability. Improvements in the ability to control and maintain COM motions within the base of support may in turn enhance stability in running and standing, reduce the incidence of falls, increase maximal running speeds (as muscle force can be optimized to create forward directed motion and to avoid motion in other directions), and improve the ability to maneuver or change direction.

The apparatus may be referred to as an agility trainer, which is in the form of an exercise rehabilitation device that may be used to improve balance and stability during walking, running and/or standing in people with muscular, neurological or skeletal impairments. The device also may be used to improve balance and stability in healthy people or people who may otherwise benefit from such intervention, such as athletes or people in particular professions, such as manual laborers or military and rescue personnel.

The agility trainer is provided in the form of a robotic system capable of applying known forces at the pelvis of a subject (person or user) in a manner both feasible for use during walking and highly controllable in a haptic environment. The system is intended to provide interventions targeting locomotor stability and is capable of providing continuous frontal-plane forces to the pelvis during treadmill walking. The system is able to create highly controlled forces to be applied in movement amplifications or other applications, such as applying impulse perturbations. The example system shown uses two motors to apply the forces in a single degree of freedom, but it will be appreciated that additional motors may be added to control forces in multiple degrees of freedom.

In general, the system advantageously may be used to provide highly controllable bilateral forces directly to a subject, such as during walking. The forces may either challenge or assist a subject's stability or control of lateral motion. The challenge or assistance may be implemented progressively. The system may be used to create movement amplification or movement damping force fields by providing proportional forces based on real time monitoring of the subject's lateral or fore-aft velocity. For instance, the system may create a negative viscosity force field or movement amplification proportional to the subject's lateral velocity.

The system permits exploration of a subject's ability to adapt using feedforward and/or feedback mechanisms. People use feedforward and feedback mechanisms to control rhythmic movements. Feedforward strategies include internal models and impedance mechanisms that are particularly valuable for responding to predictable and unexpected disturbances, respectively. With neurologic impairment, reliance on impedance mechanisms (e.g. posture and muscular co-contractions) to resist perturbations can compensate for decreased ability to use feedback mechanisms (e.g. corrective steps), which require accurate sensing of and response to stimuli. Following iSCI, cautious gait patterns, including wide steps and increased double-support time, suggest that impedance mechanisms are utilized. In contrast, non-impaired people likely minimize impedance contributions to gait stability due to negative impacts on energetic efficiency and maneuverability during community ambulation.

Stated in other words, a continuous force applied to the person may be learnable because the magnitude of the external force is controlled by the subject's own movements. In this situation where movement amplification is provided, the subject will be able to develop an internal model (predictive model) of the external force field. The learning that takes place that may improve stability will be similar to learning to control one's own movements, as opposed to learning how to respond to an unpredictable external perturbation.

The system may be employed in a variety of configurations and with various components. Example preferred embodiments are provided that may be referred to as a cable robot system, which uses hardware including actuators to create bilateral forces that are applied to the pelvis of a subject. In this example, a set of series elastic actuators powered by linear motors are used to create the bilateral forces, but it will be appreciated that other types of actuators could be used. The bilateral forces also are applied via a cable transmission system and may be prescribed in ways that alter the subject's balance and stability by making lateral control of the body more or less challenging. It will be appreciated that the term "cable" is not intended to be limiting and is used to represent an elongated flexible element that may be of numerous configurations, such as a cord, rope, wire, strap, etc. The system may be used in conjunction with a treadmill or configured to accommodate short over-ground walking, and may provide a large workspace that allows corrective steps to be safely made during walking. The series elastic linear motors or other actuators may be used in any application where highly controllable force outputs are required over a large workspace. The hardware is connected to a control system that interacts in real time to monitor the movement of the subject and control the actuators to adjust the applied forces.

In a first aspect, the disclosure provides an agility trainer apparatus, including a harness configured to be worn by a person, a first cable having a first end connected to a left side of the harness and having a second end extending laterally outward, a second cable having a first end connected to a right side of the harness and having a second end extending laterally outward, the second end of the first cable being connected to a first movable assembly that is movable fore and aft as the harness is moved fore and aft, the second end of the second cable being connected to a second movable assembly that is movable fore and aft as the harness is moved fore and aft, a first load cell operably connected to the first cable between the harness and the first movable assembly, a second load cell operably connected to the second cable between the harness and first movable assembly, at least a third cable having a first end connected to at least a first actuator, the third cable having a second end connected to the first movable assembly and being configured to move the second end of the first cable, at least a fourth cable having a first end connected to at least a second actuator, the fourth cable having a second end connected to the second movable assembly and being configured to move the second end of the second cable, and a control system configured to drive the first and second actuators to apply lateral loads to the first and second cables, respectively.

Thus, the agility trainer advantageously is designed to be highly adaptive to the subject and to be able to act in real time to assist or challenge the subject's stability. It will be appreciated that bilateral forces may be applied to the subject when standing, walking without advancement of a treadmill belt or during active use of a treadmill. It will be appreciated that the device may be used to impose a variety of force fields for various exercise and/or rehabilitation purposes.

As above noted, the example agility trainer apparatus and example methods of using the same of this disclosure provide several advantageous features. It also is to be understood that both the foregoing general description and the following detailed description are exemplary and provided for purposes of explanation only, and are not restrictive of the claimed subject matter. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of example intranasal expandable occlusion devices, including other plan and section views of the example shown, and of examples that may have alternative configurations, have not been included, such details are considered within the comprehension of those of skill in the art in light of the present disclosure. It also should be understood that the present invention is not limited to the example embodiments illustrated.

DETAILED DESCRIPTION OF THE PREFERRED EMBODIMENT

Figure 1:
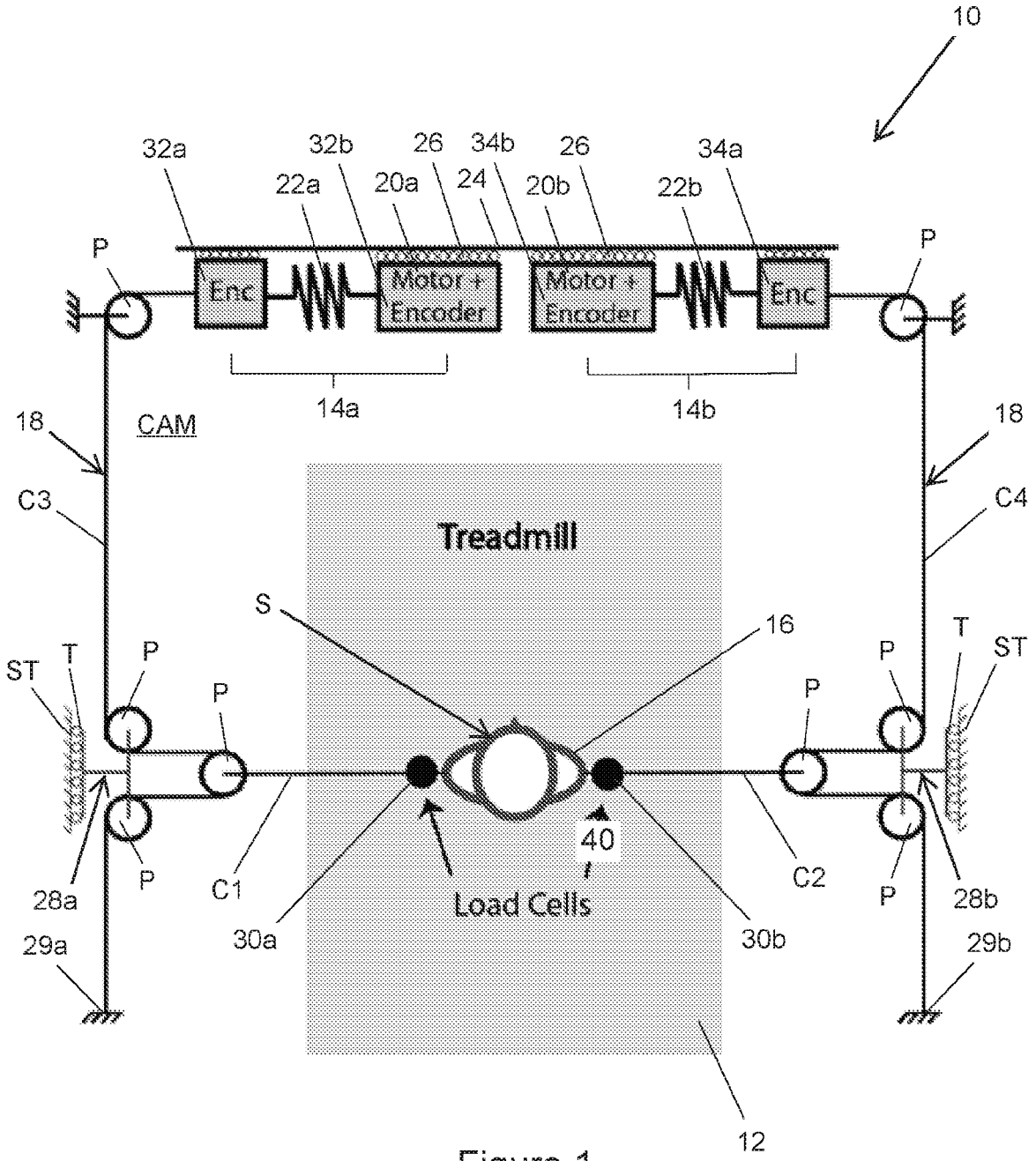
FIG. 1 is a schematic top view diagram of an example agility trainer hardware system used to generate and apply forces, shown in position for use in combination with a treadmill.
Figure 2:
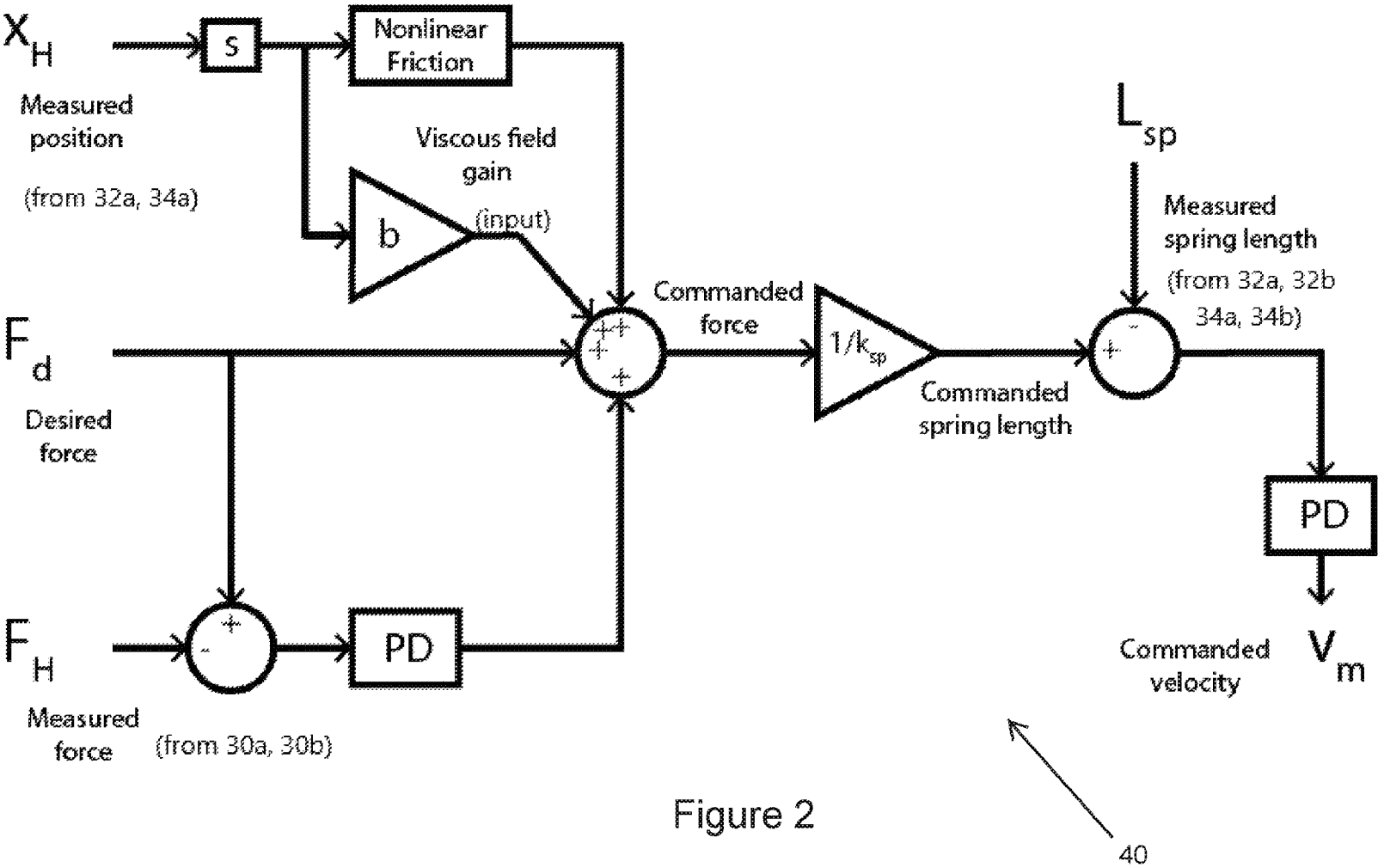
FIG. 2 is a schematic diagram that illustrates a first example of control system architecture configured to be used in conjunction with and to operate the agility trainer hardware system shown in FIG. 1.

FIG. 1 provides a schematic top view diagram of an example agility trainer hardware system 10. FIGS. 2 and 3 provide first and second alternative control systems 40, 140 that may be used with the hardware system 10 to provide bidirectional control and application of forces to a subject when standing and/or during locomotion, such as walking, for instance on a treadmill 12.

The system 10 includes first and second independent series elastic actuators (SEAs) 14*a*, 14*b* that apply forces bilaterally to a harness 16, such as a pelvis harness, via a cable transmission system 18. The pelvis harness 16 may be worn by a subject S, such as a person having an impairment from a stroke or iSCI, or a healthy person having no impairment. Each actuator 14*a*, 14*b* further includes a respective linear motor 20*a*, 20*b* (Baldor, USA) connected in series with a respective biasing element 22*a*, 22*b*, such as an extension spring. In this example, the motors 20*a*, 20*b* are connected to a fixed guide rail having a magnetic track 24 (1.6 m length), and guided by low-friction linear bearings 26 (THK, USA).

Force is transmitted to the subject via a series of cables C, pulleys P, and trolleys T. A first cable C1 has a first end connected to a left side of the harness and a second end extending laterally outward. A second cable C2 has a first end connected to a right side of the harness and a second end extending laterally outward. The second end of the first cable C1 is connected to a first movable assembly 28*a* that is movable fore and aft as the harness 16 is moved fore and aft. The second end of the second cable C2 is connected to a second movable assembly 28*b* that is movable fore and aft as the harness 16 is moved fore and aft. Each movable assembly 28*a*, 28*b* of this example includes a double-pulley configuration in conjunction with a trolley T that rides along a respective sidetrack ST allows the subject S unrestricted fore-aft motion while maintaining lateral force control. The setup shown creates a 2:1 mechanical advantage for force generation, but other configurations may be utilized.

While the agility trainer may be used with a treadmill or configured to accommodate short over-ground walking, it also will be appreciated that various treadmills having different specifications could be used with the agility trainer. For example, the agility trainer may be anchored around an oversized treadmill 12 (TuffTread, USA, belt width 1.39 m) that allows subjects space to safely perform lateral maneuvers. Depending on the location and surroundings, anchoring of the system components may be to portions of a frame, wall structures or the like that extend along the front and sides of the treadmill 12. It will be appreciated that the subject S also may wear a further harness or have the pelvis harness 14 connected to a passive overhead safety device (Aretech, Ashburn, Va.), providing no bodyweight support but effectively providing fall arrest to prevent injury to the subject S in the event that the subject S may stumble or tend to fall. Additionally, it will be appreciated that the system may be used in conjunction with providing visual feedback to the subject about a desired location on the treadmill or floor. For example, feedback can be provided to a subject by using a monitor or observer (see for example FIG. 3*b*) located in front of the subject, or by projecting a direction on the belt of the treadmill or floor relating to the location of the subject's COM. Target locations may be provided and subjects may be instructed to attempt to move the subject's COM location to a specified target in the various force fields.

Sensing of both cable motion and forces permits a real-time control scheme. A first load cell 30*a* (Omega, USA) is operably connected to the first cable C1 between the harness 16 and the first movable assembly 28*a*. A similar second load cell 30*b* is operably connected to the second cable C2 between the harness 16 and the second movable assembly 28*b*. For instance, the load cells 30*a*, 30*b* provide force data and may be directly connected to the pelvis harness 16, to the respective movable assemblies 28*a*, 28*b*, or along the respective cables C1, C2 therebetween. First optical encoders 32*a*, 32*b* (Renishaw, UK) on either side of the first biasing element or spring 22*a*, and comparable second encoders 34*a*, 34*b* on either side of the second biasing element or spring 22*b* measure respective spring extension (5 μm resolution) and lateral velocity of the subject (5 mm/s resolution).

At least a third cable C3 has a first end connected to at least the first SEA 14*a*. The third cable C3 is in communication with the first movable assembly 28*a* via running through its double-pulley configuration, and has a second end shown as being connected to a fixed location 29*a*, which may be part of a frame or wall. However, it will be appreciated that the second end of the third cable C3 could be moveable, such as by being connected to a motorized winch or other movable device that could be connected to a frame or wall and used to coarsely adjust the length of the cable, so that a subject's mediolateral motions are not limited by the length of the magnetic track 24 to which the first SEA 14*a* is movably connected. The configuring and movement of the third cable C3 ultimately facilitates movement of the second end of the first cable C1, and in turn, adjusts the lateral force applied by the first cable C1 to the harness 16.

At least a fourth cable C4 has a first end connected to at least the second SEA 14*b*. The fourth cable C4 is in communication with the second movable assembly 28*b* via running through its double-pulley configuration, and has a second end shown as being connected to a fixed location 29*b*, which similarly may be part of a frame or wall. However, consistent with the aforementioned alternatives for the third cable C3, it will be appreciated that the second end of the fourth cable C4 could be movable, such as by using a movable device to coarsely adjust the length of the fourth cable C4, so that a subject's mediolateral motions are not limited by the length of the magnetic track 24 to which the second SEA 14*b* is movably connected. The configuring and movement of the fourth cable C4 ultimately facilitates movement of the second end of the second cable C2, and in turn, adjusts the lateral force applied by the second cable C2 to the harness 16.

Each motor 20*a*, 20*b* is driven using a Flex+Drive II servo drive (Baldor, USA), although it will be appreciated that alternative components may be used. The entire system 10 is controlled by a control system, such as one of the example control systems 40, 140 and, for example, using a cRIO-9074 FPGA using LabVIEW Real-Time software (National Instruments, USA), being configured to drive the first and second actuators 14*a*, 14*b* to apply lateral loads to the first and second cables C1, C2, respectively. As with respect other components, alternative control system components and configurations may be utilized.

The example system 10 uses series-elastic actuators 14*a*, 14*b* because of their ability to render accurate forces at the desired magnitudes and bandwidth of human interaction, while being back-drivable for comfort and safety of the subject. This, in part, allows the subject S to move freely around the treadmill 12, or in over-ground walking. Using linear motors 20*a*, 20*b* was advantageous+ in order for the system 10 to be back-drivable and have zero backlash due to the absence of a gear train. However, it will be appreciated that alternative actuators and/or motors may be utilized with varying differences in performance.

FIG. 2 is a schematic diagram that illustrates an example control system 40 for use with the hardware system 10. Due to some anticipated nonlinear effects and parameter uncertainties in the model of the cable system, the control scheme for each SEA 14*a*, 14*b* uses a combination of inner and outer feedback control loops. An inner loop is used in which a cancellation controller compensates for identified non-linear dynamics of the pulley-cable-cart system, wherein the controller reads real-time states to perform cancellation. As shown and labeled in FIG. 2, the system has four inputs: $X_h$—lateral position of the human subject as measured from the respective optical encoders 32*a*, 32*b*, 34*a*, 34*b*, $F_d$—the desired baseline force we would like to apply to the subject S, $F_h$—measured force from the load cell 30*a*, 30*b*, and $L_{sp}$—measured length of the biasing element or spring 22*a*, 22*b* from the respective optical encoders 32*a*, 32*b*, 34*a*, 34*b*.

As further shown and labeled in FIG. 2, an outer proportional-derivative (PD) control loop operates on force feedback from the load cells 30*a*, 30*b* to account for movement of the subject S as well as errors in the feedforward model. A simple static feed-forward model of a spring ($k^{-1}$ $mN^{-1}$) is used, as well as a nonlinear correction at low velocities to account for static friction in the bearing/rail interface. The nonlinear friction model is a rapidly decaying exponential function [$f^*=a^*e^{b\dot{X}_h}+c$] based on velocity of the subject S. This essentially provides an outer loop in which a general PD controller acts to reject un-modeled dynamics and random disturbances. There is an expectation that the cancellation controller will be incomplete because of observed non-linearities in the pulley system. In addition, because the subject will not act as a pure source of motion, and has uncertain and varying effective impedance, the subject introduces un-modeled dynamics as the body is mechanically coupled to the mechanism. This provides a unique controller design that is specific to this application of SEA to human-machine interaction for accurate haptic rendering to the COM.

An inner PD control loop shown and labeled in FIG. 2 positions the respective motor 20*a*, 20*b* such that a target spring extension of the respective biasing element or spring 22*a*, 22*b* is achieved based on the desired force, the non-linear friction model, and the force error seen by the outer PD loop. All control loops and sensor inputs may operate at a sampling frequency of 1 kHz. It should be noted that any typical bearing system will exhibit non-linear damping or friction. Hence, when transmission or redirection of cable force is necessary, there needs to be a way to achieve accurate force control. While use of feedback control from a force sensor can mitigate some errors in force rendering, the noise and bandwidth of force sensors present inherent limitations. However, a cancellation controller that employs feedback of motion states can contribute to improved performance by taking into account identified systematic sources of parasitic dynamics, namely, non-linear damping or friction.

Each motor 20*a*, 20*b* is driven using velocity control, which simplifies the model. Then, the inner PD loop is used to control spring extension. It is contemplated that performance of the system may be improved by driving the motors 20*a*, 20*b* using current/torque control and performing a full system identification in order to create a more accurate feedforward model.

It is recognized that one drawback of using SEAs 14*a*, 14*b* along with a cable-driven system is that it is necessary to maintain some minimum tension in the cable system to obtain accurate force and position measurements. A baseline force, such as 50N, may be used in each actuator 14*a*, 14*b* to maintain continuous tension in the cables C1, C2, C3, C4.

The primary function of the agility trainer system 10, with control system 40, is to render accurate force perturbations that can be functions of movement states. The primary example of these are based on velocity, for example, stabilizing or destabilizing damping on the COM. These may be employed in environments where a subject S is walking, standing or running. This is accomplished by using the control system 40 to command the hardware system 10 to render velocity-based forces to the pelvis harness 16, which vary according to the subject S based on lateral center of mass (COM) velocity in real-time, such as during walking. Lateral COM velocity is measured for feedback using the optical encoders 32*a*, 32*b*, 34*a*, 34*b*. By using pre-tension in the system 10 to maintain a taught cable C1, C2, the velocity from the encoders 32*a*, 32*b*, 34*a*, 34*b* can be used to calculate lateral COM velocity. The strength and direction of the force fields may be adjusted by varying the viscous gain (b). If b>0, this creates a positive viscous field that applies forces opposite in direction of COM velocity. If b<0, this creates a negative viscosity field that applies forces in the same direction as COM velocity.

Applied forces may be varied with the intended condition and amplification. Force field conditions may include stabilization, destabilization and null. During a stabilization condition, a subject S experiences a variable force proportional in magnitude and opposite in direction to real-time lateral COM velocity. For instance, in one example utilization of the system viscosity gains may be 427±78 N/(m/s) and applied forces may be 110N or less. This viscous force field may reduce the requirements to actively maintain straight-ahead walking. Indeed, the system may create viscous force fields that include both positive and negative force fields.

Perturbations are another function of the agility trainer system that is separate from the application of viscous force fields. Perturbations are generally destabilizing, as well. During a destabilization condition, random bidirectional force perturbations normally distributed for instance from −33 to 33N may be applied, such as at 3 Hz. Perturbation magnitude may be selected to be challenging but manageable for subjects S with iSCI. Perturbation frequency may be faster than step frequency to encourage feedforward adaptations, and will tend to increase requirements to actively maintain straight-ahead walking. During a null condition, no forces are applied and the cables may be slackened.

Data may be acquired and managed in various ways. For example, a 10-camera motion capture system (Qualysis, Gothenburg Sweden) (indicated by CAM in a simplified manner in FIG. 1 for ease of viewing) may have the multiple cameras situated around the subject S to record 3D coordinates of reflective markers located at specific points on the subject S. For instance, the markers may be located on the pelvis (superior iliac crests, anterior-superior iliac spines) and bilaterally on the greater trochanter, lateral knee, lateral malleolus, calcaneus, and second and fifth metatarsals during gait.

The kinematic marker data may be processed using Visual3D (C-Motion, Germantown, Md.) and a custom MATLAB (Mathworks, Natick, Mass.) program. Marker data may be low pass filtered (Butterworth, 6 Hz cut-off frequency) and gap-filled. Time of initial foot contact (IC) and toe-off (TO) may be identified with each step based on fore-aft positions of the calcaneus and $5^{th}$ metatarsal markers. A Visual 3D pelvis model may be created using the 8 pelvis markers. Mediolateral COM position may be calculated as the center of the pelvis model.

For each step, the peak lateral COM speed as a net measure of COM control may be identified. To assess how control is instituted, calculations may be made of step width, step time, and minimum MOS. Step width may be calculated as the medio-lateral distance between the left and right $5^{th}$ metatarsal markers at IC. COM velocity may be calculated as the derivative of COM position. Peak lateral COM speed was identified as the maximum absolute COM velocity between IC events. Step time may be calculated as time between successive IC's.

MOS may be calculated using the following equation to first identify the extrapolated center of mass (XCOM) position:

$$XCOM=COM+COM'*\sqrt{l/g}$$

XCOM=lateral extrapolated center of mass
COM=lateral center of mass position
COM'=lateral center of mass velocity
l=pendulum length
g=gravitational constant "l" is the instantaneous distance between COM and the lateral malleolus MOS may be calculated as the distance between the XCOM and the base of support (BOS), approximated as the lateral position of the $5^{th}$ metatarsal marker on the side of the last IC. MOS may be positive when the XCOM is medial of the BOS. Minimum MOS may be identified during the stance phase of each step. An estimate of the time course of any after-effects may be provided by fitting an exponential function to all kinematic metrics, and step width may be the most robust at describing the observed after-effects period.

Figure 3A:
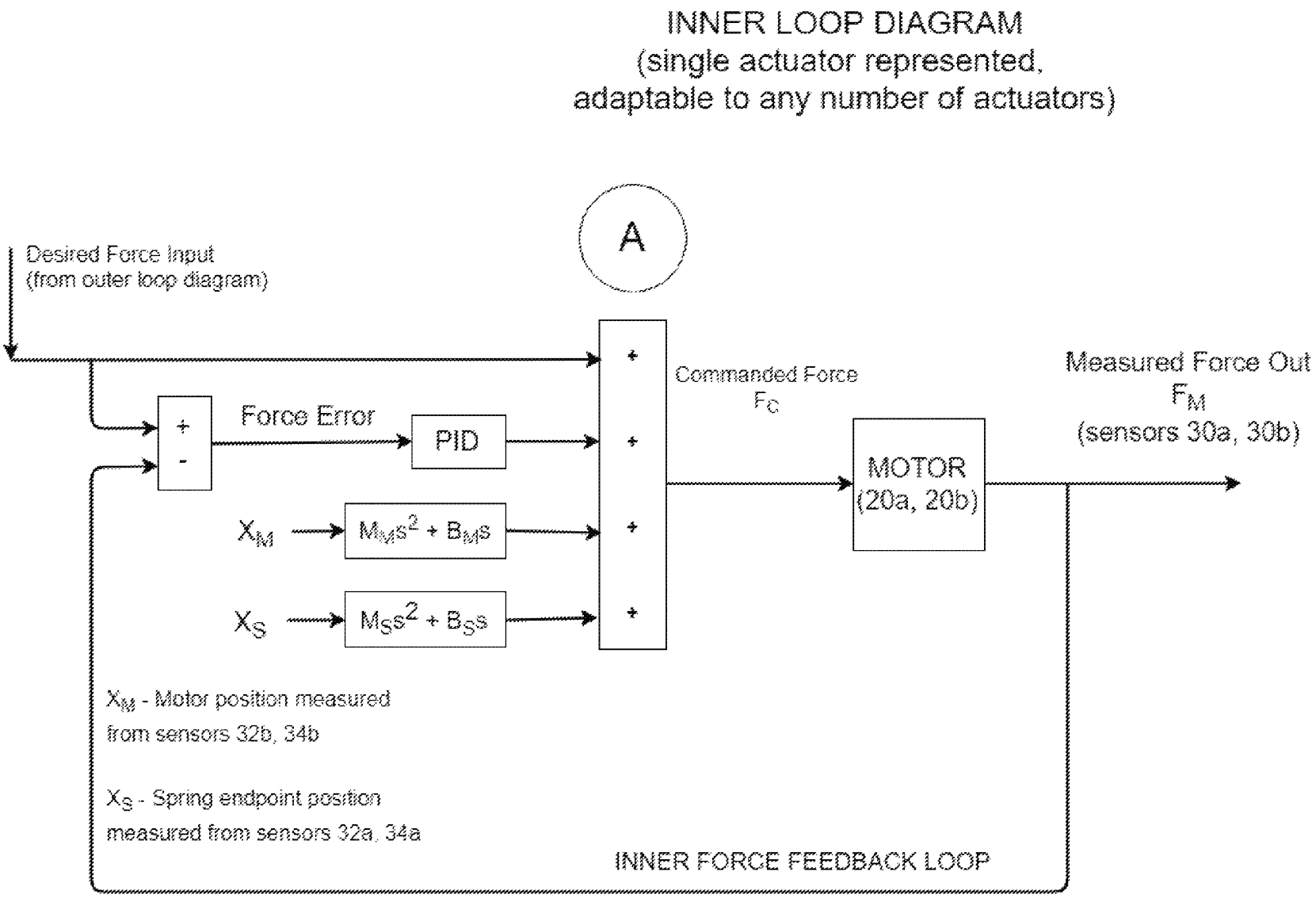
FIG. 3A is a schematic diagram that illustrates an inner control loop of a second example of control system architecture configured to be used in conjunction with and to operate the agility trainer hardware system shown in FIG. 1.
Figure 3B:
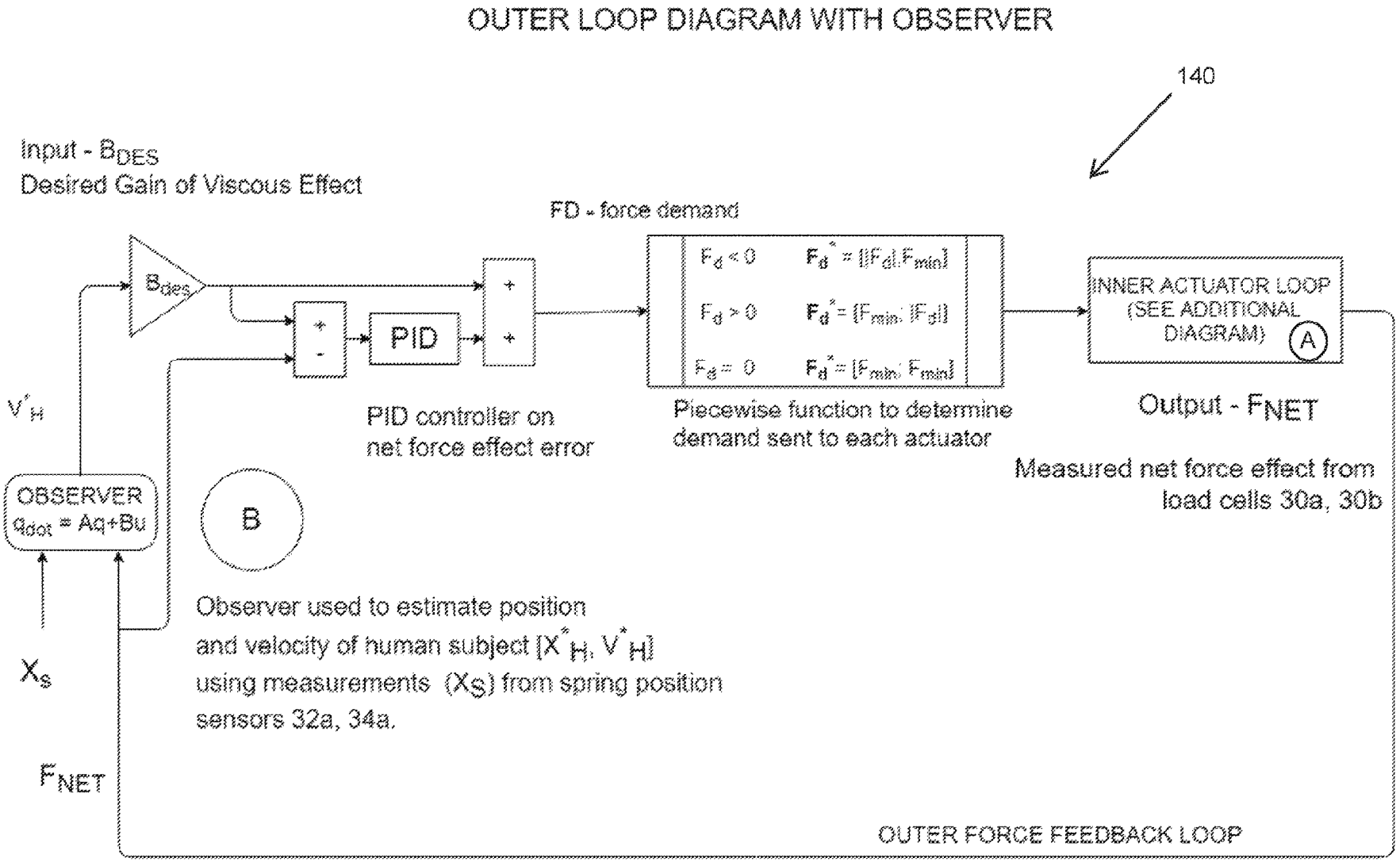
FIG. 3B is a schematic diagram that illustrates an outer control loop and its association with the inner control loop of FIG. 3A of the second example of control system architecture configured to be used in conjunction with and to operate the agility trainer hardware system shown in FIG. 1.

FIGS. 3A and 3B are schematic diagrams that illustrate a second example control system 140 for use with the hardware system 10. Two key points on the diagrams are labeled A and B for purposes of ease of description herein.

In FIGS. 3A and 3B, the control system 140 has system inputs that include $B_{des}$ which is the desired viscous field effect gain in units of Ns/m. This creates a force proportional to the velocity of the subject S. The sign (±) of this gain determines if the field resists, or amplifies the subject's movement.

The control system 140 also has system outputs that include $F_m$, the main output of this system, which are the measured forces from the load cells 30*a*, 30*b* connected to the pelvis harness 16 worn by the subject S. For the 2-cable system, this is a vector containing the real-time measure of the force applied to each side of the subject. The system outputs also include $X^*_h$ and $V^*_h$, which are the estimated position and velocity of the subject S, as determined from an observer, as discussed further herein. This velocity is used in conjunction with the desired viscous gain ($B_{des}$) to determine the force effect desired to be applied to the subject S.

The control system 140 shown in FIGS. 3A and 3B has system states, both measured and unmeasured/estimated. The measured states include $X_m$, which are position measurements taken from the respective optical encoder 32*b*, 34*b* attached to each respective motor 20*a*, 20*b*. This is a vector containing the measured position of each motor 20*a*, 20*b* in real time. Additionally, $X_s$ are position measurements taken from the other endpoint of the biasing element or spring 22*a*, 22*b* (the end that isn't attached to the motor 20*a*, 20*b*). This also is a vector containing the real time position of both endpoints of the respective spring 22*a*, 22*b*. These measurements are used to both model and cancel the dynamics of the system 10 in order to obtain accurate force control. The dynamic cancellation referred to would include items like the inertial and frictional effects of the respective motor 20*a*, 20*b*, motor bearings, pulleys P, and cables C1, C2, C3, C4.

The unmeasured/estimated system states include $F_c$, which is the total force command sent to the plant/motors 20*a*, 20*b*. For the sake of the system diagram this is a 2-term vector containing the real time force command for each respective motor 20*a*, 20*b*. The way in which this command is determined is explained below in the discussion of the decision points. Additionally, $X^*_h$ and $V^*_h$ are listed above as outputs to the system, but they are included here as well to emphasize that the system 10 is not measuring the position of the subject S directly. Rather, a combination of the force sensors and upstream position sensors are being used to estimate the position of the subject S.

The FIGS. 3A and 3B diagrams of the second example control system 140 include two main decision points, namely, point A, which represents a main summation block or inner control loop, and point B, which represents an outer force control loop with an observer.

With respect to point A, this represents the main summation block in the system 140. This block is where a determination is made for the final input to the system 140 as a force command that will be sent to each motor 20*a*, 20*b*. This is determined by adding together 4 terms. First, the desired force effects $F^*_d$ are included. This actually is a set point. These are the desired forces to be produced by each motor 20*a*, 20*b*, independently. These forces are determined from the input ($B_{des}$—the desired viscous gain) and the outer feedback loop, both of which will be discussed further herein.

The other key element to the desired force effects, is the use of a piecewise function to determine which motor 20*a*, 20*b* produces a certain force. This is because of the nature of a cable-driven system, in which it is only possible to pull with each motor 20*a*, 20*b*, and never push. So, when it is desired to add a viscous effect, one side is required to do all work to create the effect, and the other side must just maintain minimum tension in the cables to prevent slack, $F_{min}$. For example, if the desired effect is a constant +5N to the right, the system must request the second motor 20*b* on the right side to increase tension by 5N, while the first motor 20*a* on the left remains at its minimum value.

The second term is the feedback term from the inner force feedback loop. The inner force feedback loop uses proportional-integral-derivative (PID) control on the error between the desired forces for each motor ($F^*_d$—described above) and the actual measured forces from the load cells 30*a*, 30*b* connected to the pelvis harness 16 on the subject S. The purpose of this term, and the inner force feedback loop, is to ensure closed loop control on each actuator 14*a*, 14*b* in the system 140 independently. That is, it is desirable to make sure each actuator/motor 14*a*/20*a*, 14*b*/20*b* is producing the requested force reasonably well.

The next two terms in the summation block are the dynamic cancellation terms. These terms use the measured real-time position, velocity, and acceleration of each motor 20*a*, 20*b* as well as each respective spring 22*a*, 22*b* endpoint, in order to try to cancel out any inertial and frictional effects inherent in the plant (mass of motor/bearings, friction of bearings and pulleys, etc.). These terms are included in the plant as well, which is how this example system is modeled.

So in summary, all of these terms added together provide the desired forces for each actuator 14*a*, 14*b* based on whatever field effect is trying to be achieved, and includes terms for closed loop feedback (PID control), and feedforward dynamic cancellation.

With respect to point B in FIG. 3B, this represents the outer force control loop with an observer within the control system 140. As seen in FIG. 3B, a second feedback loop is used in this example system to obtain a desired haptic force effect. This is referred to as the "outer force feedback" loop. This loop differs from the "inner" feedback loops of FIG. 3A in that it uses the net force on the subject, calculated from the effect of all actuators in the system on the subject. In this case, it is just the two motors 20*a*, 20*b*, so the net force is trivially just force on the right side minus force on the left side. Thus, the main point of this outer loop is to ensure both/all of the actuators 14*a*, 14*b* in the system are working together to produce the desired effect. Whereas the point of the inner loop is to ensure each specific actuator 14*a*, 14*b* is performing appropriately, regardless of what the other motor(s) do.

Now, in order to perform closed loop control on the force/velocity relationship of the subject S, the system must have information on the force and velocity of the subject S. Obtaining the force information is relatively easy because there are force sensors in the form of load cells 30*a*, 30*b* directly connected to the pelvis harness 16 worn by the subject S, which can be measured directly. It will be appreciated that it would be possible to place sensors or load cells in other locations to estimate the forces applied to the subject. For example, load cells could be placed between the pulleys (on the fore-aft trolley system) and the base of the fore-aft trolley system. While obtaining the force information is relatively easy, obtaining velocity information is more difficult. The position sensors 32*a*, 32*b*, 34*a*, 34*b* are located upstream from the subject S, near the respective motor 20*a*, 20*b*, with many pulleys P and cables C1+C3, C2+C4 in between. So, in order to obtain the velocity of the subject S, a first calculation is made of an analytical/geometric measure of the subject's position, assuming static conditions, using the upstream position sensors 32*b*, 34*b*. This cannot be used directly as the measure of the subject's position in dynamic situations because of errors that arise, such as slack in the cables C1, C2, C3, C4. Thus, as shown and labeled in FIG. 3, it is desirable to use a state space Observer to estimate position of the subject S based on the forces applied, the calculated position assuming static conditions, and a simple mass-damper model of human dynamics (note: this model is used mainly to tune the response of the observer, not to make robust real-time predictions of human movement).

An estimated human lateral velocity $V^*_h$ is obtained from the observer. This then is multiplied by the main input to the system, the desired viscous gain $B_{des}$, and that provide the desired net force effect on the subject S to be created by the system 10, based on the subject's own real time lateral velocity. This desired effect is compared with the measured forces being applied to the subject S in order to close the outer feedback loop. Another PID controller acts on the error of the outer feedback loop, and that contributes to the desired net effect, as well. All of this is fed back into the piecewise function described earlier to determine the forces sent to each motor 20*a*, 20*b*.

Figure 4:
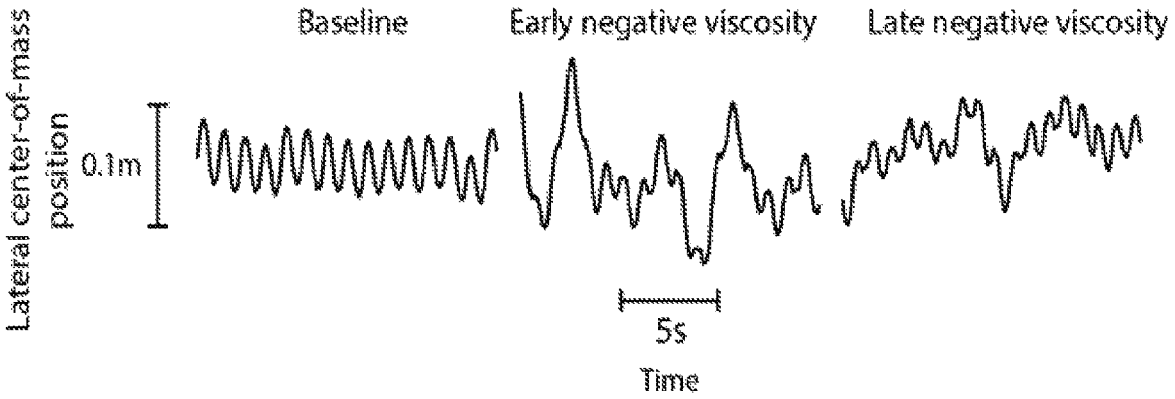
FIG. 4 is a graph of the lateral center of mass position for a subject shown when utilizing the agility trainer hardware system of FIG. 1 and control system of FIG. 2 and walking in baseline and negative viscosity force fields or movement amplification.

Turning to FIG. 4, lateral COM position data from a sample subject S is shown. During Early exposure to a Negative Viscosity field, the subject's COM position was much more irregular and contained much larger deviations compared to Baseline walking. This suggests that the subject S had greater difficulty controlling lateral COM trajectory while walking in the Negative Viscosity force field compared to Baseline walking. Results from the Late exposure to the Negative Viscosity field show the subject S adapted to the field over time and exhibited an increased ability to control lateral COM motion as compared to the early condition. It will be appreciated that the present hardware system 10 and control system 40, 140 are capable of measuring, recording and presenting data in numerous advantageous ways, while initiating stabilizing, destabilizing and null conditions.

The disclosed agility trainer system provides a novel and highly advantageous exercise and rehabilitation apparatus that may be used to apply a movement amplification paradigm to a person that may be walking, while experiencing fore and aft movement. The system may provide bilateral forces to the subject in an effort to help improve stability, whether the subject is impaired, such as by stroke or iSCI, or is not impaired but seeks improved agility. The system provides an opportunity for real time interventions that assist or challenge stability to help a subject improve stability, while permitting both feedback and feedforward learning and execution. While the disclosed system is susceptible of embodiment in many different forms, examples are shown in the drawings and described herein with the understanding that the present disclosure can be considered as an exemplification of the principals of the invention and is not intended to limit the invention to the examples illustrated, and is only limited by the appended claims and legal equivalents thereof.

The invention claimed is:

1. An agility trainer apparatus, comprising:

a harness configured to be worn by a person;

a first cable having a first end connected to a left side of the harness and having a second end extending laterally outward;

a second cable having a first end connected to a right side of the harness and having a second end extending laterally outward;

the second end of the first cable is connected to a first movable assembly that is movable fore and aft as the harness is moved fore and aft;

the second end of the second cable is connected to a second movable assembly that is movable fore and aft as the harness is moved fore and aft;

a first load cell operably connected to the first cable between the harness and the first movable assembly;

a second load cell operably connected to the second cable between the harness and first movable assembly;

at least a third cable having a first end connected to at least a first actuator;

the third cable having a second end connected to the first movable assembly and being configured to move the second end of the first cable;

at least a fourth cable having a first end connected to at least a second actuator;

the fourth cable having a second end connected to the second movable assembly and being configured to move the second end of the second cable; and a control system configured to drive the first and second actuators to apply lateral loads to the first and second cables, respectively.

2. The apparatus of claim 1 wherein the harness is a pelvis harness.

3. The apparatus of claim 1 wherein the first and second movable assemblies are configured to translate along respective first and second sidetracks.

4. The apparatus of claim 3 wherein each of the first and second movable assemblies further comprises a double pulley configuration and a trolley that is movable along a respective sidetrack.

5. The apparatus of claim 1 further in combination with a treadmill on which the person may walk.

6. The apparatus of claim 5 wherein the apparatus is configured to project a direction on the treadmill.

7. The combination of claim 5 wherein the apparatus is anchored along front and sides of the treadmill.

8. The apparatus of claim 1 wherein the control system is configured to cause the actuators to apply forces to the harness that promote stability.

9. The apparatus of claim 1 wherein the control system is configured to cause the actuators to apply forces to the harness that create perturbations.

10. The apparatus of claim 1 wherein each actuator further comprises a series elastic actuator.

11. The apparatus of claim 10 wherein each actuator further comprises a linear motor connected in series with a biasing element.

12. The apparatus of claim 11 wherein the biasing element further comprises an extension spring.

13. The apparatus of claim 11 wherein optical encoders are disposed on either side of the biasing element of each actuator and the optical encoders measure biasing element extension and lateral velocity of the person.

14. The apparatus of claim 11 wherein each linear motor is connected to a fixed guide rail having a magnetic track and is guided by low-friction linear bearings.

15. The apparatus of claim 1 wherein the control system further comprises an inner proportional-derivative control loop and an outer proportional-derivative control loop.

16. The apparatus of claim 15 wherein the control loops process real time data received from the first and second actuators.

17. The apparatus of claim 1 further comprising a second harness connected to a passive overhead safety device.

18. The apparatus of claim 1 further comprising a monitor.

19. The apparatus of claim 1 wherein the second end of the respective third cable and fourth cable is movable.

20. The apparatus of claim 1 wherein the second end of the respective third cable and fourth cable are fixed.

* * * * *